US005218728A

United States Patent [19]

Lloyd et al.

[11] Patent Number: 5,218,728

[45] Date of Patent: Jun. 15, 1993

[54] VIBRATION ISOLATION APPARATUS FOR VEHICLE SLEEPER BEDS

[75] Inventors: David Lloyd, Prescott, Wis.; Ronald J. Geiser, Hastings, Minn.

[73] Assignee: Mac Ride, Inc., Bloomington, Minn.

[21] Appl. No.: 973,886

[22] Filed: Nov. 10, 1992

[51] Int. Cl.[5] ..... A47C 17/80

[52] U.S. Cl. ..... 5/118; 248/631; 248/562; 248/913

[58] Field of Search ..... 5/101, 104, 118, 244; 248/581, 583, 562, 631, 619, 913

[56] References Cited

U.S. PATENT DOCUMENTS

| | | | |
|---|---|---|---|
| 3,371,359 | 3/1968 | Dome | 5/118 |
| 3,760,436 | 9/1973 | Zach et al. | 5/118 |
| 3,882,558 | 5/1975 | Christensen | 5/118 |
| 3,951,373 | 4/1976 | Swenson et al. . | |
| 3,954,245 | 5/1976 | Costin . | |
| 3,990,668 | 11/1976 | Thompson et al. . | |
| 4,144,601 | 3/1979 | Anderson et al. | 5/118 |
| 4,196,483 | 4/1980 | Lefler et al. | 5/118 |
| 4,198,025 | 4/1980 | Lowe et al. . | |
| 4,363,377 | 12/1982 | Van Gerpen . | |
| 4,384,700 | 5/1983 | Thompson et al. . | |
| 4,497,078 | 2/1985 | Vogel et al. | 5/118 |
| 4,596,373 | 6/1986 | Omi et al. | 248/562 |
| 4,684,100 | 8/1987 | Grassl . | |
| 4,729,538 | 3/1988 | Bergacker et al. . | |
| 4,733,847 | 3/1988 | Grassl . | |
| 4,793,583 | 12/1988 | Bergacker et al. . | |
| 4,979,248 | 12/1990 | Kelley | 5/118 |

*Primary Examiner*—Michael F. Trettel
*Attorney, Agent, or Firm*—Haugen and Nikolai

[57] ABSTRACT

A sleeping bed for a motor vehicle which is effectively isolated from jars and vibrations encountered during highway travel comprises a movable frame which is supported by inflatable air bags from a stationary frame affixed to the floor of the vehicle. Three position valves control the in-flow and out-flow of air from the air bags, the valve being mechanically coupled by linkages to the movable frame so that its relative displacement controls the pressure within the air bag. The movable frame is supported on the pistons of the air bags by first and second slide members which permit longitudinal and transverse horizontal movement of the movable frame. Springs are employed to restore the movable frame to a neutral horizontal position following acceleration/deceleration forces tending to move the movable frame and mattress in the fore and aft direction and when longitudinal sway forces act on the bed. Effectively coupled in parallel with the air bags and the spring assemblies are hydraulic or air cylinders which function as dampeners to prevent extreme overshoot and/or oscillation of the movable frame following a sudden displacement.

11 Claims, 2 Drawing Sheets

VIBRATION ISOLATION APPARATUS FOR VEHICLE SLEEPER BEDS

BACKGROUND OF THE INVENTION

I. Field of the Invention

This invention relates generally to a sleeping bed sleeping bed assembly for use in motor vehicles, such as over-the-road tractor/trailer rigs and recreational vehicles, and more particularly to apparatus for isolating the bed from effects of shock and vibration to which the vehicle is subjected when traveling.

II. Discussion of the Prior Art

Over-the-road truckers often drive in teams in which one person drives while the other rests. Modern semi-tractors include a sleeping compartment disposed behind the driver and passenger seats, and this sleeping compartment is equipped with a bed for accommodating a recumbent individual. Likewise, recreational vehicles and motor homes often include one or more beds. With such motor vehicles, and especially semi-tractors which tend to have a stiff suspension system, shocks and vibrations caused by the vehicle hitting irregularities in the pavement surface, negotiating turns, accelerating and decelerating can be transferred to the individual trying to rest and thus disturbing his/her sleep. When it is considered that serious highway accidents have been attributable to drivers who are not well rested, it is important that they be allowed to sleep soundly while another driver operates the vehicle so that transport time will not be unduly increased.

Others have addressed the problem of attempting to properly isolate a sleeping bed in a motor vehicle from shock and vibration forces. In the Lefler et al. U.S. Pat. No. 4,196,483, there is described a bed arrangement comprising a mattress support frame supported over a base and secured for vertical movement through the use of an air cylinder and valve combination which functions as an air spring. The valve operates such that air is introduced into the air spring when a force tends to draw the movable frame toward the stationary frame and will exhaust air from the air spring when the two frames tend to move apart. No provision is made in the Lefler et al. bed arrangement to accommodate shock and vibration forces directed other than vertically. That is to say, no attempt is made to counteract breaking and acceleration forces or side-to-side sway of the vehicle.

The Vogel et al. U.S. Pat. No. 4,497,078 also is concerned with isolating a sleeper from shock and vibration in a vehicle-mounted bed. It, like the Lefler et al. device, incorporates air bags disposed at the foot end and head end of the bed and operating along a vertical axis to cushion up-and-down movement of a movable frame relative to a truck-mounted stationary frame. Unlike the device of the Lefler et al. patent however, the Vogel et al. system also incorporates an air spring disposed in a horizontal plane and operatively coupled to dampen out shock and vibration forces directed horizontally in the fore and aft direction. Vogel et al. further recognizes the problem with air bags in that they may violently overshoot and "launch" the sleeper into the air, especially when a sudden impact occurs in the vertical direction, such as when the truck encounters a pothole or similar flaw in the road surface. By providing an accumulator with each of the air bags, such overshoot and continued oscillation is removed.

The present invention is deemed to be an improvement over the prior art as represented by the Lefler et al. and Vogel et al. patents in that it provides resistance to inertial forces acting in all three axes, i.e., vertically, fore & aft and side-to-side. Moreover, the system of the present invention is greatly simplified in that only two air bags are required, one at the head of the bed and one at its foot, both operating along a vertical axis to resist the tendency of the moveable frame and mattress to move up-and-down. Furthermore, by incorporating a hydraulic cylinder as a snubber connected in parallel with the air bags, any tendency for the moveable frame to overshoot in the upward direction following a sudden compression is obviated. In the present invention, no air bags and associated valve mechanisms are utilized for resisting fore-to-aft motion and side-to-side motion. Instead, tension springs are effectively used to couple the moveable frame to the stationary frame and then air cylinders, functioning as dampeners, are used to suppress any tendency for the moveable frame to oscillate following the application of horizontally-directed forces to the bed and its occupant.

SUMMARY OF THE INVENTION

The present invention provides a shock and vibration isolation apparatus for a sleeping bed adapted to be installed in a motor vehicle where the motor vehicle has a floor surface on which the bed can rest. It includes a stationary frame member affixed to the floor surface of the vehicle and has first and second box-like housings suspended from the stationary frame and extending below the floor surface through openings formed in that floor. A movable frame for supporting a sleeping mattress is coupled to the stationary frame by way of first and second slide mechanisms. The first slide mechanism allows translational movement of the moveable frame and mattress relative to the stationary frame in a first horizontal direction while the second slide member allows translational movement of the moveable frame and mattress in a second horizontal direction perpendicular to the first. A pair of air bags are individually disposed in the box-like housings extending below the floor of the truck for imparting controlled vertical motion to the moveable frame relative to the stationary frame as the air bags are inflated and deflated. A three-position valve is coupled between a source of pressurized air and the two air bags, the valves controlling the inflation and deflation of those air bags. When the valve is in a first, neutral position, no air can enter or leave the bag. When the valve is in its second position, air is introduced into the bag to inflate it and thereby elevate the movable frame. When the valve is in its third position, air is released from the bag to the atmosphere, causing the moveable frame to drop. Hydraulic dampening cylinders are operatively coupled between the stationary frame and the moveable frame for limiting oscillatory movement of the moveable frame in the vertical direction. First and second pneumatic cylinders are coupled between the first and second slide mechanisms for limiting oscillatory movement of the moveable frame and mattress in both the first and second horizontal directions.

The bed assembly of the present invention incorporates one or more tension springs coupled between the moveable frame member and the first slide mechanism for constraining the length of travel of the moveable frame member in the first horizontal direction. Similarly, second tension springs are operatively coupled between the moveable frame member and the second slide mechanism for constraining the length of travel of the moveable frame in the second horizontal direction. Air snubbers are coupled in parallel with the spring sets to limit overshoot and oscillation.

DESCRIPTION OF THE DRAWINGS

Further features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
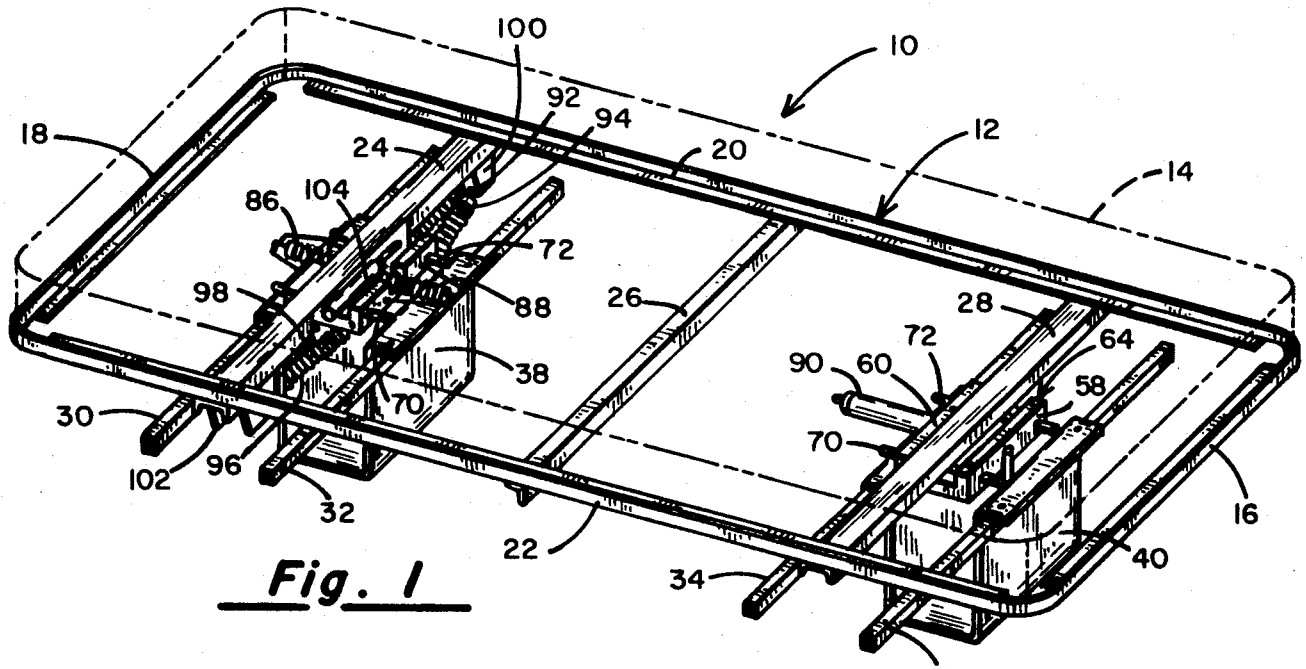
FIG. 1 is a perspective view of the shock and vibration isolation apparatus for a vehicle's sleeping bed.

The perspective view of FIG. 1 illustrates, in general terms, the constructional features of the present invention. It is indicated generally by numeral 10 and includes a first, upper, movable frame 12 for supporting a mattress 14 thereon. The frame 12 comprises a foot rail 16 and a head rail 18 maintained in parallel spaced apart position by a longitudinally extending front rail 20 and a rear rail 22. The rails comprising the upper frame 12 are preferably angle or channel iron and completing this frame assembly are transversely extending braces 24, 26 and 28 which are welded or otherwise joined at their opposed ends to the front and rear frame members 20 and 22.

Located below the movable frame 12 and appropriately affixed to the floor of the semi-tractor or motor home is a stationary frame which is comprised of two pairs of parallel, spaced apart rails with rails 30 and 32 disposed proximate the head of the bed and rails 34 and 36 proximate its foot end. These rails would typically be held in place on the floor of the vehicle by bolts or other suitable fasteners.

Suspended from the rails 30 and 32 is a box-like housing 38 which is formed out of sheet metal and is welded to its supporting rails. In a similar fashion, a box-like housing 40 is suspended from the rails 34 and 36. When installed, these two boxes fit through openings cut through the floor boards of the vehicle and are thereby recessed relative to the stationary frame. Because the support structures and related hardware associated with the head end of the bed are substantially the same as that at the foot end, only the components at the foot end will be explained in great detail with the aid of FIGS. 2 through 4.

Figure 2:
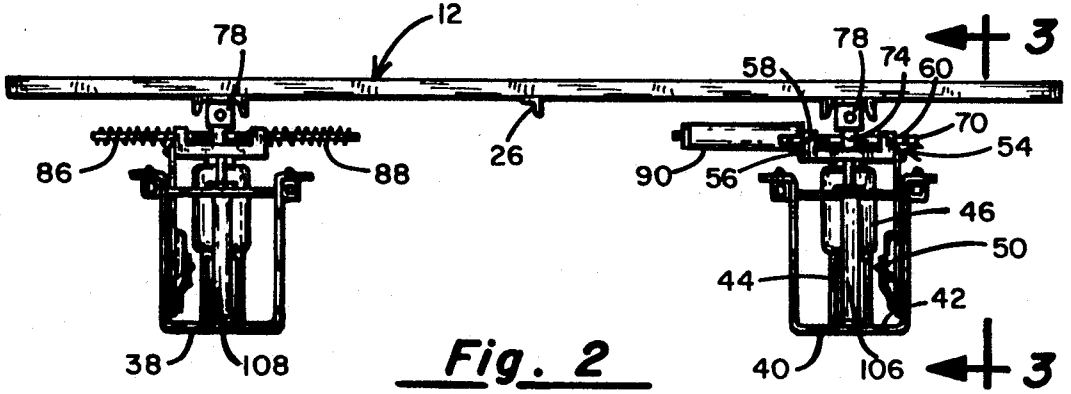
FIG. 2 is a side elevation view of the apparatus of FIG. 1.
Figure 4:
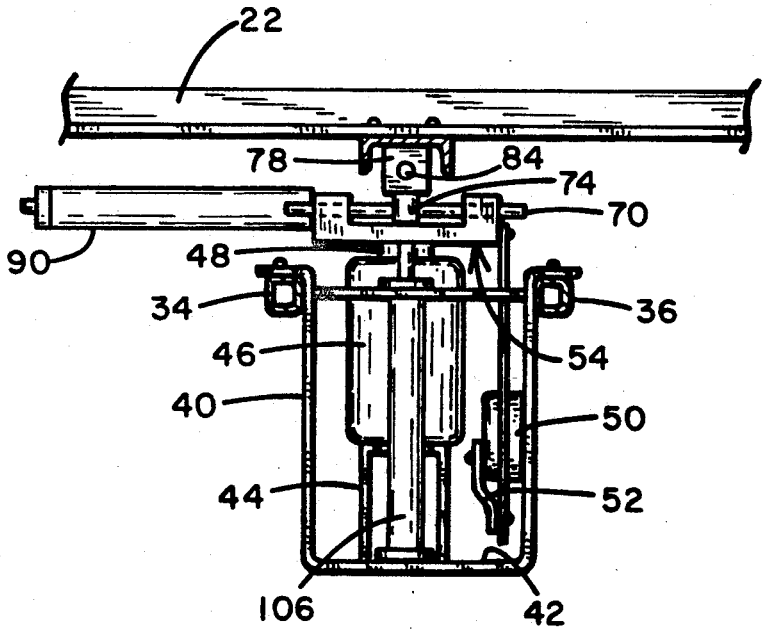
FIG. 4 is a partial side view of the foot end of the bed taken along the lines 4—4 in FIG. 3.

As can be seen in the rear side elevation of FIG. 2 and perhaps more clearly in the detailed partial view of FIG. 4, spot welded to the floor 42 of the box 40 is a generally U-shaped bracket or pedestal 44. Mounted atop the pedestal 44 is an inflatable air bag 46 which is oriented so as to have its movable piston 48 directed vertically. The air bag 46 may be a Type 050-S manufactured and sold by the Goodyear Company.

With continued reference to FIG. 4, it can be seen that there is attached to a vertical wall of the box 40 an air valve 50 which can be made to operate in any one of three states or conditions controlled by the position of the control linkage 52. The valve 50 is preferably of the type sold by Air Ride Corporation of Banksdale, Calif., and is connected in a pneumatic circuit between a source of pressurized air (not shown) and, in the case of a tractor truck, would typically comprise the air supply used with its pneumatic brake system. When the linkage 52 is in a neutral or mid-position, the valve is in a blocked condition and air can neither enter or leave the air bag 46. When the linkage 52 is in the down position illustrated in FIG. 4, the valve is open to allow pressurized air to enter and inflate the air bag and to thereby displace the piston 48 upwards in the vertical direction. When the linkage 52 is in the up position, air is allowed to escape from the air bag 46 through the valve to the ambient causing frame 12 to be lowered toward the fixed frame members 30–32, 34–36.

Referring now to FIG. 2, it can be seen that the box 38 at the head end of the bed 10 contains identical apparatus as housing 40. Attached to each of the pistons of the respective air bags are first and second slide assemblies which allow the movable frame 12 to shift horizontally in the both the X and Y axis directions. The first slide assembly comprises a U-shaped channel having its base 56 secured to the upper end of the air bag's piston shaft 48 and its parallel, spaced-apart legs 58–60 extending upward. Formed through each of the legs of the channel-shaped guide block are a pair of longitudinally extending bores 66 and 68 (FIG. 3) which are aligned so that slide rods 70 and 72 can be inserted therethrough to span the space between the upwardly projecting legs 58–60 of the guide block. It should also be mentioned that suitable sleeve bearings (not shown) are disposed in the longitudinal bores to allow the slide rods to move freely with very little friction.

Figure 3:
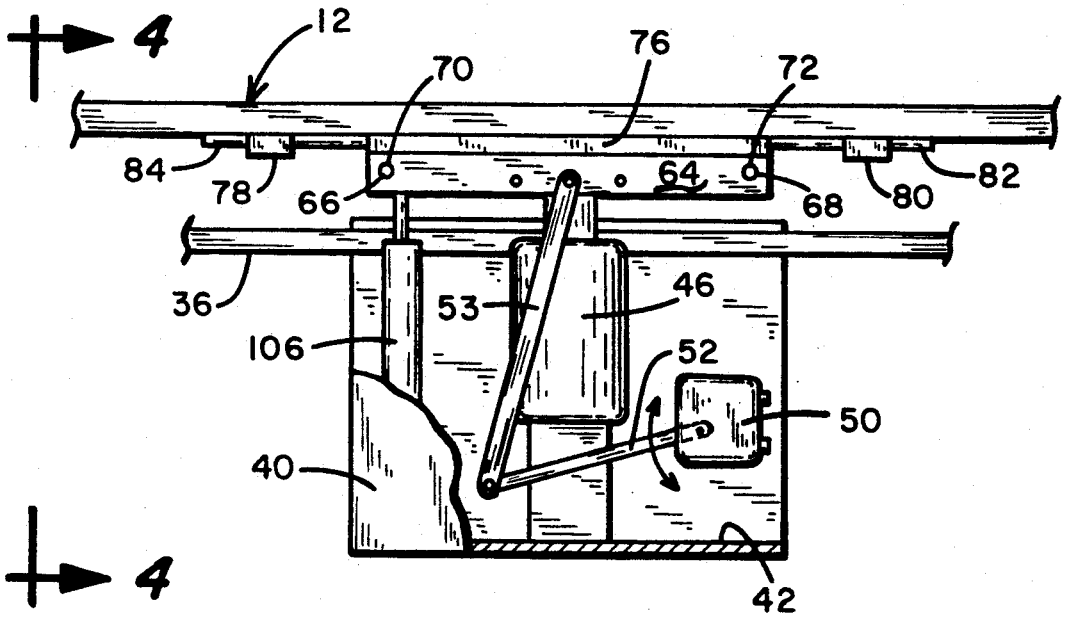
FIG. 3 is an end view taken along the line 3—3 in FIG. 2.

As can be seen in the side view of FIG. 3, the slide shafts extend through and are fixedly attached to a downwardly depending portion 74 of an elongated slide member 76. This downwardly depending portion is free to shift back and forth between the upwardly projecting legs 58–60 of the first slide member's guide block 54.

Attached to the underside of each of the cross braces 24 and 28 of the movable frame 12 are bearing blocks 78–80 which are most visible in the view of FIG. 3. These bearing blocks, too, include sleeve bearings (not shown) for cooperating with shafts 82 and 84 which project laterally outward from the opposed ends of the slide or runner 76. While the slide or runner 76 is constrained from moving fore and aft relative to the U-shaped guide block 64 by virtue of the shafts 70 and 72 which pass through each, the movable frame 12 itself, with its attached bearing blocks 78–80, can shift in the fore and aft direction along the laterally projecting shafts 82 and 84 which pass through those bearing blocks.

When driving over highways and freeways where the expansion joints in the roadway are designed to be at an oblique angle to the road, there is a tendency for a sleeper bed to vibrate or sway in the longitudinal direction of the bed, i.e., transverse to the direction of travel of the vehicle itself. Thus, it is desirable that the sleeping bed be isolated from such side-to-side motion in addition to the fore and aft motion induced by acceleration and braking of the vehicle.

Referring again to the head and slide assembly associated with box or housing 38 in the perspective view of FIG. 1, resiliently joining the movable frame 12 to the opposite ends of the piston-mounted guide blocks are opposed tension springs 86 and 88 which tend to maintain the movable frame centered in the channels of the slide guide blocks 54 when no end-to-end sway forces are acting on the bed and its occupant. An air cylinder-type snubber 90 is also operatively coupled between the movable frame 12 and the channel shaped guide block 54 and serves as a dampener to resist the tendency of the movable frame to oscillate about its center position following displacement. An air cylinder suitable for use herein is available through American Air Corporation.

In a similar fashion, opposed pairs of springs 92–94 and 96–98 are transversely oriented between brackets 100 and 102 affixed to the underside of the movable frame 12 at the head end of the bed and the opposed ends of the U-shaped channel 54. These springs function to maintain the movable frame in a generally centered position. They counteract forces in the fore and aft direction due to acceleration and braking of the vehicle. Again, to prevent oscillation in the fore and aft direction, an air snubber or dampener 104 is effectively coupled in parallel with the springs 92–94 and 96–98.

Rather than employing plural air accumulators in circuit with the air bags as in the Vogel patent, in the system of the present invention, hydraulic cylinders as at 106 and 108 (FIG. 2) are used to damp any tendency for the movable bed frame to overshoot and possibly launch the sleeping occupant upon encountering a sudden dip or bump in the road. More particularly, and as shown in FIG. 4, hydraulic cylinder 106 has one end thereof affixed to the base 42 of the box-like housing and its piston rod joined to the U-shaped channel guide block 54. The cylinder is filled with a quantity of hydraulic fluid and the piston riding in the cylinder has one or more ports of a predetermined size through which the oil may flow when the fluid on one side or the other of the piston attempts to compress the hydraulic fluid.

OPERATION

Assume that the bed of the present invention is disposed in a motor vehicle, such as a semi-tractor, with the head end rail 18 of the bed disposed behind the driver's seat on the left side of the vehicle and the foot end rail 16 of the bed disposed behind the passenger seat. Further, let it be assumed that the vehicle is driving along a somewhat uneven road surface so that periodically forces are created which effectively are directed in the vertical direction, either upwards or downwards. In most instances, because the movable bed frame is effectively supported by the air bags and because the air is a compressible fluid, modest vibration forces will be damped out and not transmitted via the movable frame and mattress to the sleeper. However, should the truck vehicle receive a jolt, such as by hitting a pot hole or other depression in the road, the stationary frame affixed to the truck will tend to fall relative to the air supported frame 12 causing the linkage arms 52 to move the air valves to their condition where more air will be made to flow into the air bag so that the movable frame will not shift appreciably in elevation. On the other hand, should the vehicle encounter a bump in the road which would tend to lift the stationary frame affixed to the vehicle's floor suddenly relative to the movable frame, the air valve is moved by linkages 52 and control arms 53 to their position where air in the air bags is vented to the ambient. This serves to lower the movable frame toward the stationary frame, thus nulling out the vertical upward shift.

As has already been mentioned, the hydraulic cylinders 106 and 108 operate to damp any tendency of the movable frame to oscillate following a sudden impact.

Next assume that the driver brakes suddenly such that inertial forces tend to thrust the movable frame in the forward direction. This stretches the springs 96 and 98, increasing the spring force in a direction to offset the inertial force. Again, the air cylinder dampener 104 acts as a snubber to damp out oscillations of the movable frame in the fore and aft direction. It should be apparent from what has already been described that if the vehicle accelerates to cause the movable frame to tend to shift in the aft direction, the springs 92 and 94 come into play to offset that movement.

In a similar fashion, forces acting on the movable frame tending to shift it in the lateral or side-to-side direction are offset by either the spring 86 or the spring 88 depending upon the direction of shift. Here, the air cylinder 90 deployed between the brackets affixed to the channel-shaped guide block 54 and the downwardly projecting portion 74 of the runner assembly is effective to preclude or at least substantially reduce any tendency for the movable frame to oscillate back and forth about its center position established by the opposed spring pairs.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A shock and vibration isolation apparatus for a sleeping bed installed in a motor vehicle where the motor vehicle has a floor surface on which said bed can rest comprising, in combination:

(a) a stationary frame member affixed to said floor surface and including first and second box-like housings supported by said stationary frame member and extending below said floor surface through openings formed in said floor surface;

(b) a movable frame member for supporting a sleeping mattress thereon;

(c) first slide means coupled to said movable frame member for allowing translational movement of said movable frame member relative to said stationary frame member in a first horizontal direction;

(d) second slide means coupled to said first slide means for allowing translational movement of said movable frame member relative to said stationary frame member in a second horizontal direction;

(e) first and second air bags individually disposed in said first and second box-like housings for imparting controlled vertical motion to said movable frame member relative to said stationary frame member as said air bags are inflated and deflated;

(f) valve means for controlling the inflation and deflation of said air bags, said valve means having first, second and third operating positions in which air enters, is retained in and leaves said air bags, respectively;

(g) linkage means coupled between said valve means and said movable frame member for placing said valve means in one of said first, second and third operating positions, depending on the vertical displacement of said movable frame member relative to said stationary frame member;

(h) hydraulic dampening means operatively coupled between said stationary frame member and said movable frame member for limiting oscillatory movement of said movable frame in the vertical direction; and (i) first and second pneumatic cylinders operatively coupled between said first and second slide means for limiting oscillatory movement of said moveable frame member in said first and second horizontal directions.

2. The apparatus as in claim 1 and further including first tension spring means operatively coupled between said movable frame member and said first slide means for constraining the length of travel of said movable frame member in said first horizontal direction.

3. The apparatus as in claim 2 and further including second tension spring means operatively coupled between said movable frame member and said second slide means for constraining the length of travel of said movable frame member in said second horizontal direction.

4. The apparatus as in claim 1 wherein said movable frame member comprises a front rail, a back rail with two end rails joining said front and rear rails in parallel, spaced-apart relation and a pair of intermediate rails extending parallel to said two end rails and joined at opposed ends to said front and back rails.

5. The apparatus as in claim 4 wherein said first slide means comprises:

(a) a pair of bearing blocks affixed to each of said intermediate rails and spaced from one another by a predetermined distance, each bearing block including a cylindrical bore therethrough extending parallel to said intermediate rails, and (b) a pair of slide bars, each having first and second shafts extending from opposed ends thereof, said shafts adapted to slide within said cylindrical bores in its associated pair of bearing blocks, said slide bars further including a pair of bores extending transverse to the length of said first and second shafts.

6. The apparatus as in claim 5 wherein said second slide means comprises:

(a) a pair of channel members, each having a generally U-shaped cross-section for receiving said slide bars therein, each of said pair of channels including a pair of parallel bores extending therethrough, the spacing between said parallel bores in said channel members corresponding to the spacing between said pair of bores in said pair of slide bars; and (b) a pair of shafts fitted through said pair of bores in each of said channels and through said pair of bores in said pair of slide bars.

7. The apparatus as in claim 6 wherein said pair of U-shaped channels are individually affixed to said first and second air bags.

8. The apparatus as in claim 6 and further including first and second tension-type coil springs, each individually joined at one end to opposed ends of each of said intermediate rails and at the other end to one of said pair of channel members.

9. The apparatus as in claim 6 and further including first and second tension springs connected between one of said pair of U-shaped channel members and said slide bar received in said one channel member, said first and second tension springs being on opposite sides of said one channel member.

10. The apparatus as in claim 9 and further including a pneumatic damper operatively coupled between one of said pair of U-shaped channel members and said slide bar associated with said one channel member.

11. The apparatus as in claim and further including pressure regulator means disposed in series with said valve means for adjusting the stiffness of said first and second air bags.

* * * * *

UNITED STATES PATENT AND TRADEMARK OFFICE

CERTIFICATE OF CORRECTION

PATENT NO. : 5,218,728

DATED : June 15, 1993

INVENTOR(S) : David Lloyd and Ronald J. Geiser

It is certified that error appears in the above-identified patent and that said Letters Patent is hereby corrected as shown below:

Column 8, line 36, "as in claim and further" should read --as in claim 1 and further--.

Signed and Sealed this

Twenty-second Day of February, 1994

Bruce Lehman

*Attest:*

BRUCE LEHMAN

*Attesting Officer*

*Commissioner of Patents and Trademarks*